US011470990B2

(12) United States Patent
Donegan

(10) Patent No.: US 11,470,990 B2
(45) **Date of Patent: *Oct. 18, 2022**

(54) HANGER SPACER TAPE

(71) Applicant: Stephen P. Donegan, Los Angeles, CA (US)

(72) Inventor: Stephen P. Donegan, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/074,394

(22) Filed: Oct. 19, 2020

(65) Prior Publication Data

US 2021/0030182 A1 Feb. 4, 2021

Related U.S. Application Data

(63) Continuation-in-part of application No. 16/382,153, filed on Apr. 11, 2019, now Pat. No. 10,806,284, which is a continuation of application No. 16/051,438, filed on Jul. 31, 2018, now Pat. No. 10,299,615.

(51) Int. Cl.

| | |
|---|---|
| ***A47G 25/14*** | (2006.01) |
| ***A47G 25/06*** | (2006.01) |
| *A47F 5/00* | (2006.01) |
| *A47G 25/74* | (2006.01) |

(52) U.S. Cl.

CPC ..... *A47G 25/1471* (2013.01); *A47G 25/0692* (2013.01); *A47F 5/005* (2013.01); *A47G 25/06* (2013.01); *A47G 25/145* (2013.01); *A47G 25/743* (2013.01); *A47G 25/746* (2013.01)

(58) Field of Classification Search

CPC ..... A47G 25/1442; A47G 25/145; A47G 25/251471; A47G 25/26; A47G 25/0692; A47G 25/06; A47G 25/746; A47G 25/743; A47G 25/1471; A47F 5/005

USPC ..... 211/30–33, 124, 105.1, 85.3, 123; 223/87, 88, 85, 98

See application file for complete search history.

(56) References Cited

U.S. PATENT DOCUMENTS

| | | | | |
|---|---|---|---|---|
| 2,895,618 | A | 7/1959 | Nathan | |
| 4,361,241 | A | 11/1982 | Stoddard | |
| 4,760,929 | A | 8/1988 | Fedorchak | |
| 4,960,213 | A | 10/1990 | Pfeifer | |
| D503,046 | S * | 3/2005 | Caiazzo | A47G 25/06 D6/327 |
| 7,028,855 | B2 | 4/2006 | Edwards | |
| 9,782,030 | B1 | 10/2017 | Bell et al. | |
| 10,299,615 | B1 * | 5/2019 | Donegan | A47G 25/0692 |
| 2006/0278594 | A1 | 12/2006 | Macon | |

FOREIGN PATENT DOCUMENTS

JP 2006068465 A * 3/2006

* cited by examiner

*Primary Examiner* — Devin K Barnett
(74) *Attorney, Agent, or Firm* — Pacifica IP

(57) ABSTRACT

A hanger spacer tape device having a flexible elongated body and a plurality of bumps or protrusions formed on one side thereof. The hanger spacer tape device allows hangers to be spaced at intervals and stay aligned to provide effective and efficient organization of hangers and can be coiled onto itself. The hanger spacer tape device can also include an adhesive and parallel troughs formed along a length of the hanger spacer tape device.

7 Claims, 16 Drawing Sheets

HANGER SPACER TAPE

CROSS-REFERENCE TO RELATED APPLICATIONS

This application is a continuation-in-part of U.S. Non-Provisional application Ser. No. 16/382,153, filed Apr. 11, 2019, which is a continuation of U.S. Non-Provisional application Ser. No. 16/051,438, filed on Jul. 31, 2018, the disclosure of which, including any materials incorporated by reference therein, are incorporated herein by reference in its entirety.

BACKGROUND OF THE INVENTION

The present invention generally relates to a hanger spacer device, more particularly to a hanger spacer tape device that can adhesively attach to a closet rod or pole. The hanger spacer tape is provided with a plurality of bumps or protrusions spaced at predetermined intervals allowing hangers to be spaced according to the predetermined spacing of the bumps or protrusions.

Closet organization has been a challenge to many, namely, to keep one's closet neat and organized so that articles of clothing can be readily found. One issue stems from the fact that there are many types of hangers that are available to consumers, such as wire, plastic and wooden with metal hook portions, to name a few. But even with the use of the same (or similar) hangers, a closet can oftentimes appear disorganized. Articles or clothing are necessarily shifted around, making the closet appear untidy, leaving items difficult to find. Organization of hanging items, however, is not necessarily unique to personal closets, and can also be a problem for clothing retail stores.

Attempts have been made to improve clothing organization, but each have notable drawbacks. Examples can be seen in U.S. Pat. Nos. 2,895,618, 4,361,241, 4,760,929, 4,960,213 7,028,855 9,782,040 U.S. Patent Application Publication No. 2006/0278594, and U.S. Pat. No. D247,085, each incorporated by reference herein.

In contrast to the aforementioned publications, the hanger spacer device in accordance with the present invention is simple to install, has the ability to be used on a variety of surfaces and in various locations, low-profile and can be discreet. Specifically, the hanger spacer device in accordance with the present invention keeps hangers (and clothes thereon) aligned, spaced at predetermined intervals, giving the closet an overall organized, clean look. Another advantage provided by exemplary embodiments of the present invention is that one can sort and view articles of clothing without disrupting the spacing of other articles of clothing in the closet. Another advantage provided by exemplary embodiments of the present invention is that when an item is removed, the hanger remains in the same place, again, not disrupting the placement of the other items in the closet.

The present invention also allows users to single, double, or triple space (or more, as desired by the user) items easily thereby giving the user the ability to customize his/her closet in accordance with his/her wardrobe. For example, bulkier items such as jackets may require additional spacing. Protrusions can also be intentionally "skipped" to leave spaces to create separation between different categories of clothing, allowing for further organization of the closet. Sections can be created by skipping a series of spacing elements. Overall, the present invention allows a user of the device to customize and organize as the user sees fit. The spacing elements keep the hung items aligned, spaced evenly, and looking organized. Moreover, the low-profile appearance of the present invention does not further clutter the look of the closet.

With the present invention, clothes can still be moved in either direction to allow for adjustment according to a user's desires or preferences.

The present invention allows a user to customize the length of tape being needed to fit a variety of closet spaces (or other area, not limited to closets that may require similar organization). In other words, the present invention is efficient, functional, and has the ability make any closet (or other space) appear organized.

SUMMARY OF THE INVENTION

A hanger spacer device for keeping hangers spaced at predetermined intervals comprising a flexible elongated main body having a length and a width, wherein the length is longer than the width, the main body portion having a top surface and a bottom surface, wherein the flexible elongated main body portion is flexible both lengthwise and widthwise.

The hanger spacer device also comprises a plurality of protrusions comprising adjacent pairs of protrusions formed on the top surface of the flexible elongated main body, wherein the protrusions are spaced at regular intervals.

The hanger spacer device also has hanger spaces formed between each adjacent pair of protrusions, wherein a hanger can be placed in each hanger space respectively.

The hanger spacer device an adhesive provided along the bottom surface of the flexible elongated main body, wherein the hanger spacer device is configured to be mounted to a rod. The hanger spacer device can also have an elongated main body movable between a mounting position wherein the main body can become arcuate in shape to conform to an upper surface of the rod and a storage position wherein the main body can be coiled onto itself along the length of the main body in a multilayered overlapping manner.

BRIEF DESCRIPTION OF THE DRAWINGS

A more complete understanding of the present invention may be obtained with reference to the Detailed Description when taken in conjunction with the accompanying Drawings.

DETAILED DESCRIPTION OF THE INVENTION

Figure 1A:
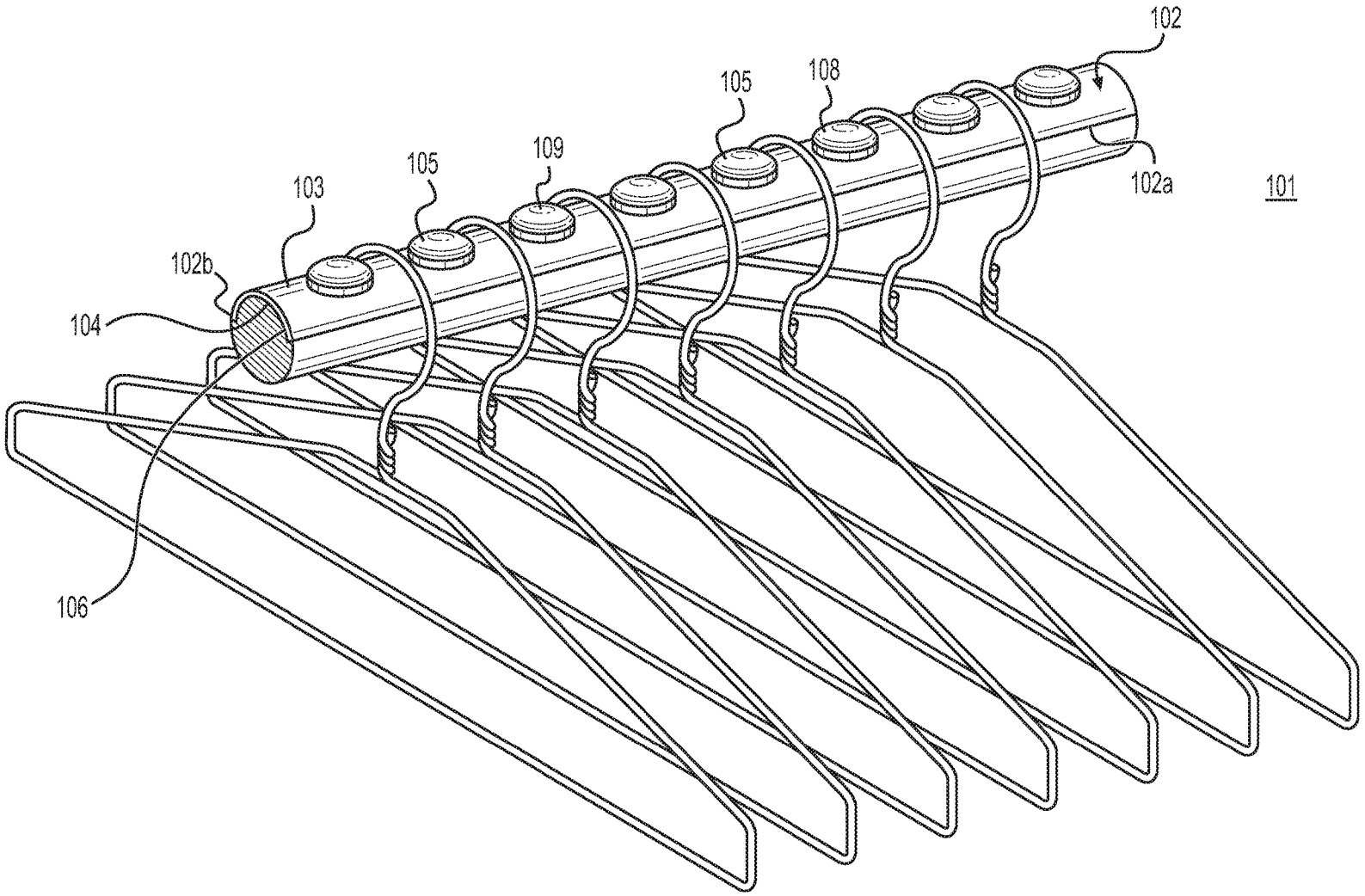
FIG. 1A is a perspective view of the hanger spacer tape in accordance with one aspect of the present invention.
Figure 1B:
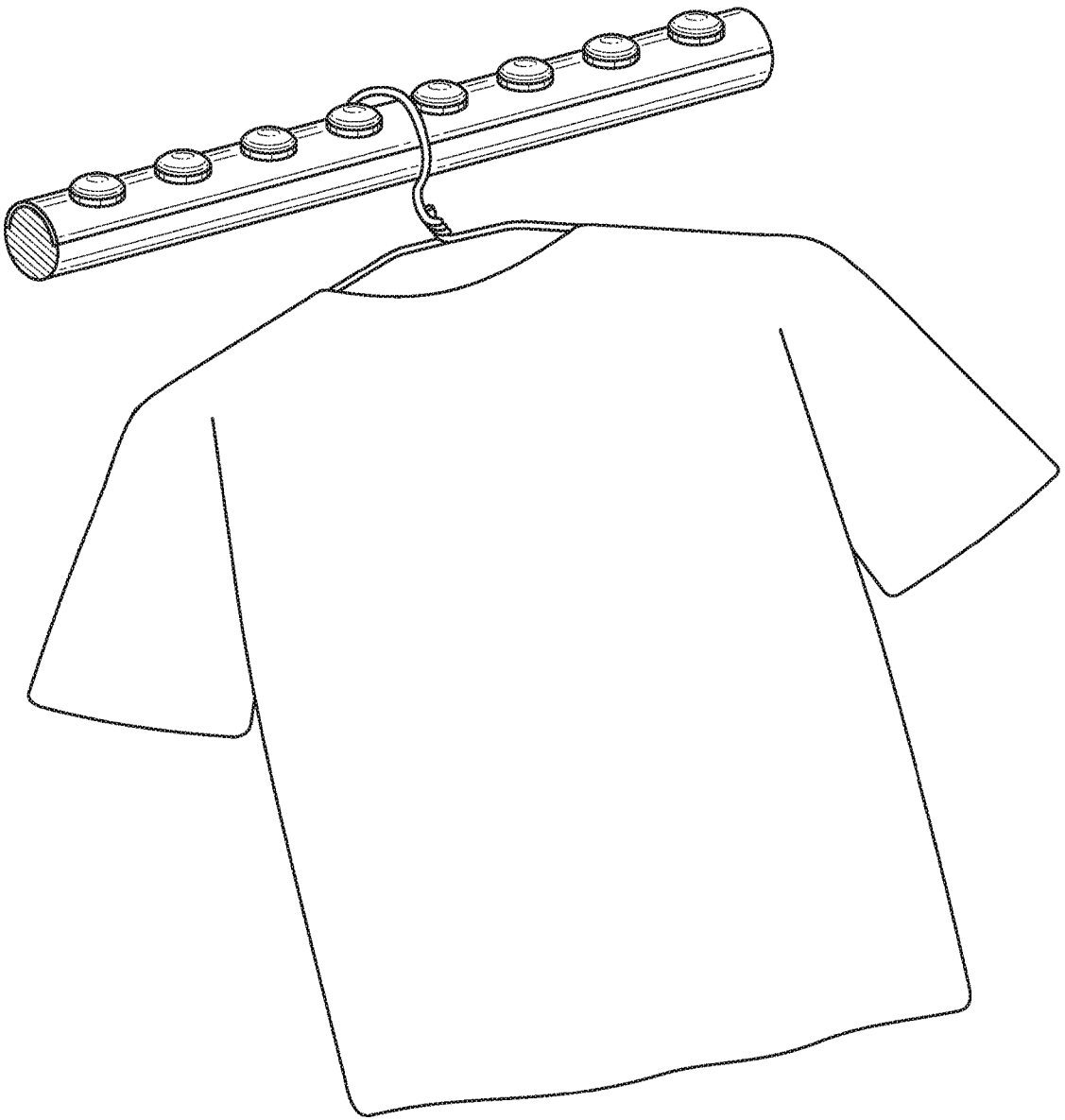
FIG. 1B is a perspective view of the hanger spacer device of FIG. 1A showing how a hanger can pivot 45 degrees on the device.

Referring now to FIG. 1, a top view of one exemplary embodiment of the hanger spacer device 101 is shown. Hanger spacer device 101 has a flexible elongated main body 102 with left and right edges 102*a* and 102*b* a top surface 103 and a bottom surface 104. Flexible elongated main body 102 is flexible both lengthwise and widthwise such that it can readily conform to surfaces of varying shapes, such as a rod or pole as shown in FIG. 1. Flexible elongated main body 102 can be in the form of a tape. The length of flexible elongated main body 102 is greater than the width of flexible elongated main body 102.

Formed on top surface 103 of the hanger spacer device 101 is a plurality of protrusions or bumps 105. The protrusions or bumps 105 are generally semispherical in shape. Provided on bottom surface 104 of the hanger spacer device 101 is an adhesive 106 that allows the hanger spacer device to stay adhered to the pole or rod. Adhesive 106 can be a glue or other substance that keeps hanger spacer device in place. Adhesive 106 can be one which can adhere to a number or materials that are commonly used to construct closet rods or poles, such as wood, plastic and metal.

Figure 2A:
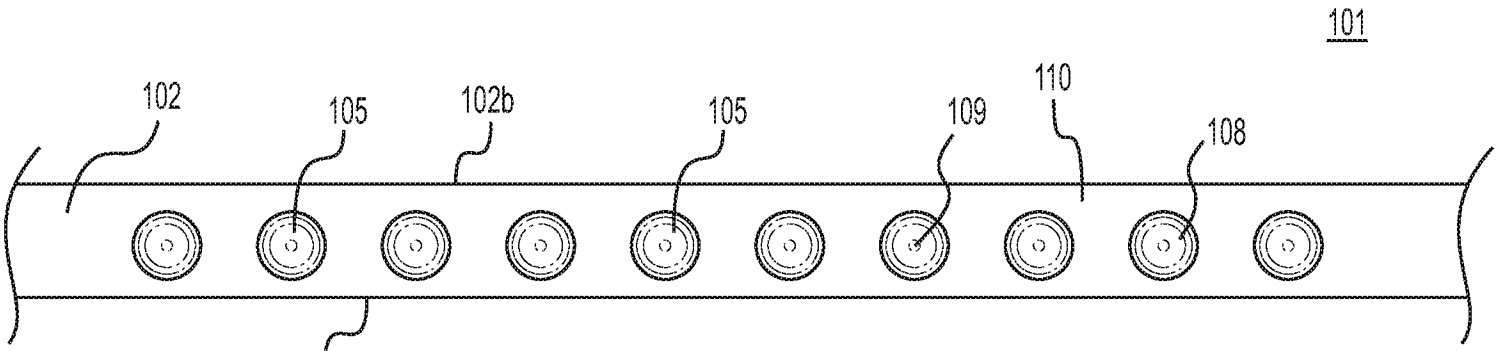
FIG. 2A is a top view of the hanger spacer tape of FIGS. 1A and 1B.
Figure 2B:
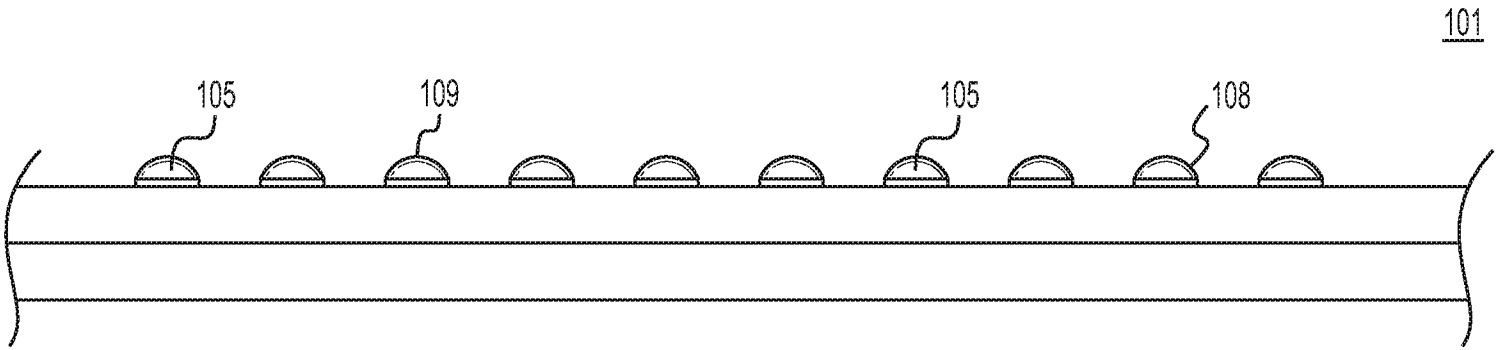
FIG. 2B is a side view of the hanger spacer tape of FIG. 2A.

In the exemplary embodiment seen in FIGS. 2A and 2B, protrusions or bumps 105 have a rim 107 that has a circumference or rim perpendicular to top surface 103 of hanger spacer device 101 when not adhered to a rounded pole or other rounded surface. Protrusions or bumps further have a rounded top 108.

Each protrusion or bump has a center 109 of rounded top 108. An ideal distance between each center 109 of the plurality of protrusions 105 has been found to be approximately ¾ inch. An ideal width of each protrusion 105 has been found to be approximately ⅜ inch. An ideal space between each of a pair of plurality of protrusions has been found to be approximately ⅜ inch. The specified spacing allows a variety of types of hangers (metal, plastic, wooden, etc.) that have varying widths to be placed between a pair or protrusions or bumps while maintaining adequate spacing between articles of clothing. The semispheric shape of the protrusions 105 allows hangers with the clothing to be turned so that a user can view the clothing item without disturbing other pieces. This can be seen in FIG. 1B. As the protrusions 105 do not extend to side edges 102*a* and 102*b* of flexible elongated main body 102, the hangers are able to pivot at least 45 degrees. The semispherical shape of the protrusions 105 also allows a hanger to slide down into space 110 in between the protrusions in the event a user places a hanger on top of the protrusion.

Moreover, in the event that bulkier articles of clothing, such as jackets, are being hung on hanger spacer tape 101, hangers can be place in every other (or every third) recess between the protrusions, creating equal spacing between those articles of clothing to achieve a clean, organized appearance. The hanger spacer tape device 102 also allows hung clothing to be pushed in either direction (like an accordion) for a user to view a selected piece of hung clothing. When the selected piece is released, the remaining pieces of clothing fall back into their original positions.

Figure 2C:
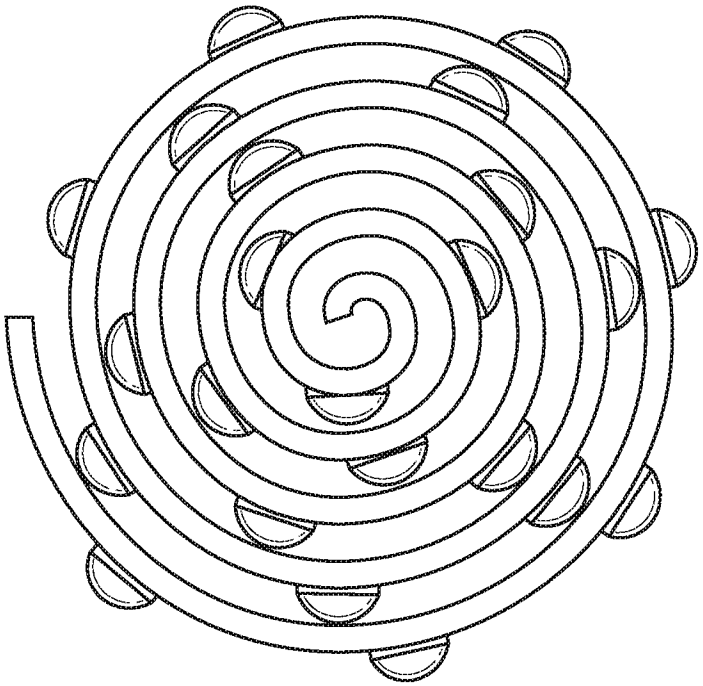
FIG. 2C is a perspective view of the hanger spacer device rolled or coiled up.

The hanger spacer tape device 102 can also be rolled or coiled onto itself as can be seen in FIG. 2C.

Figure 3A:
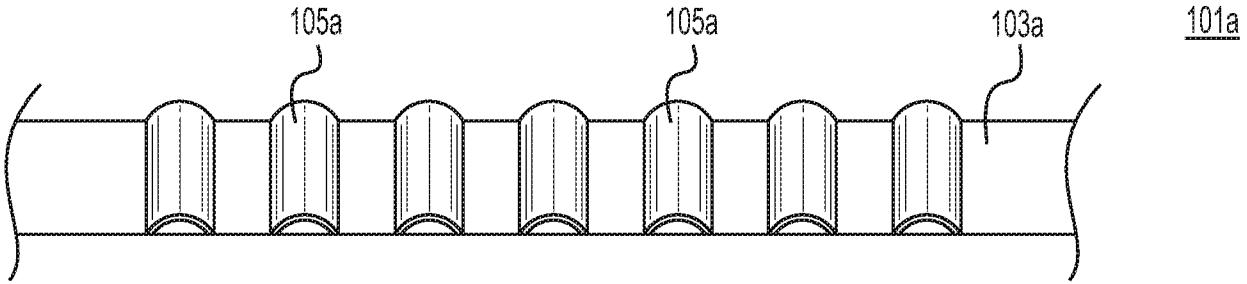
FIG. 3A is a top view of the hanger spacer tape in accordance with a second aspect of the present invention.
Figure 3B:
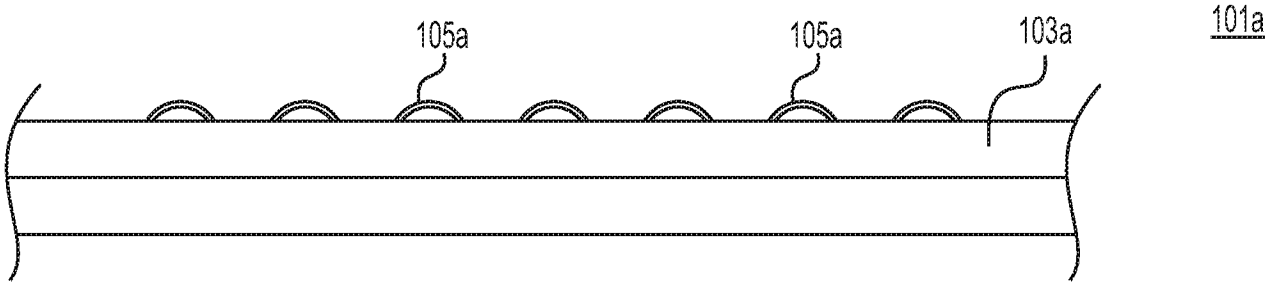
FIG. 3B is a side view of the hanger spacer tape of FIG. 3A.

An alternate embodiment is shown in FIGS. 3A & 3B, in which hanger spacer device 101*a* has a plurality of protrusions 105*a* shaped as half cylinders.

Figure 4:
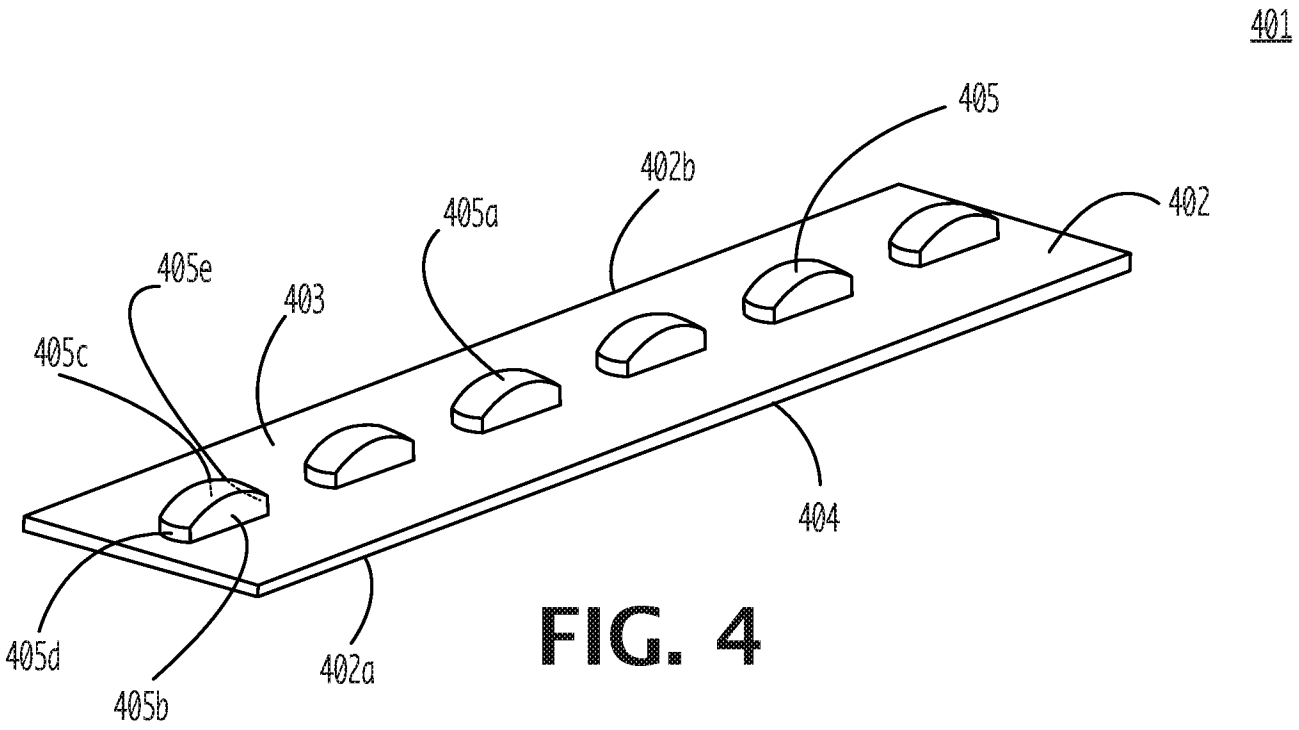
FIG. 4 is a perspective view of another embodiment of the hanger spacer tape.

FIG. 4 shows an alternate embodiment, in which a perspective view of another exemplary embodiment of hanger spacer device 401 is shown. Hanger spacer device 401 has a flexible elongated main body 402 with left and right edges 402*a* and 402*b* a top surface 403 and a bottom surface 404. Flexible elongated main body 402 is flexible both lengthwise and widthwise such that it can readily conform to surfaces of varying shapes, such as a rod or pole. Flexible elongated main body 402 can be in the form of a tape. The length of flexible elongated main body 402 is greater than the width of flexible elongated main body 402.

Formed on top surface 403 of the hanger spacer device 401 is a plurality of protrusions or bumps 405. The protrusions or bumps 405 each have a rounded top portion 405*a* and four sides 405*b-e* extending downwardly from each rounded top portion 405*a* and upwardly in a perpendicular manner from top surface 403 of the hanger spacer device 401. An adhesive can be provided on bottom surface 404.

Figure 4A:
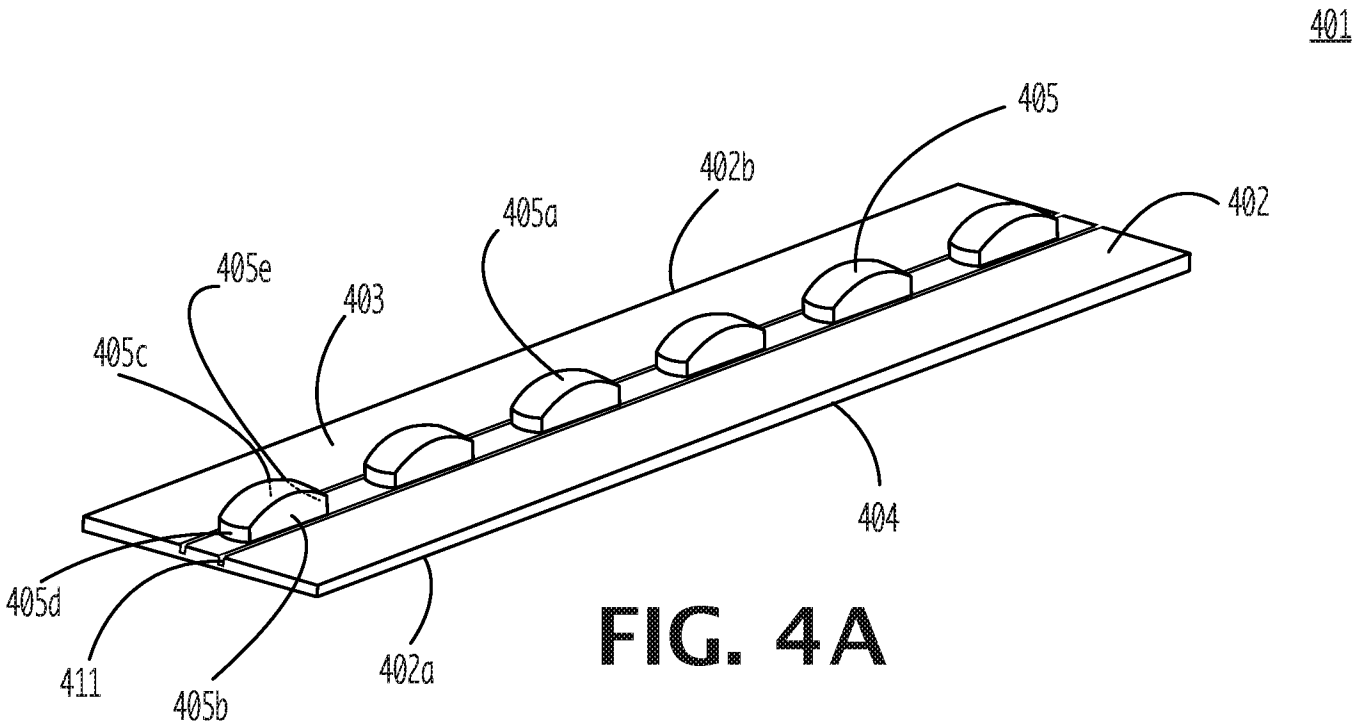
FIG. 4A is a perspective view of another embodiment of the hanger spacer tape.
Figure 4B:
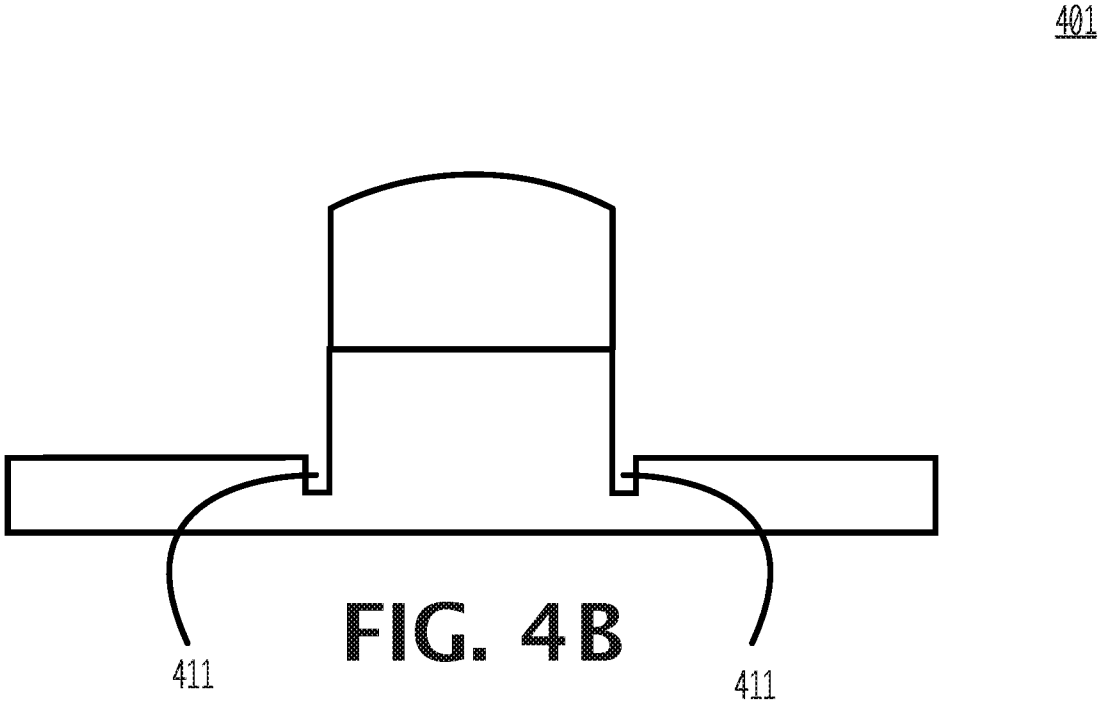
FIG. 4B is a cross-section of the hanger spacer tape of FIG. 4A.

FIGS. 4A and 4B show another embodiment of the hanger spacer tape generally shown in FIG. 4. In this embodiment, perforated sections 411 are formed along opposing sides 405*b* and 405*c* of bumps 405 to create a tough. Perforated section 411 extends below top surface 403 of hanger spacer device 401 and is formed along the length of the flexible elongated main body 402.

Figure 5:
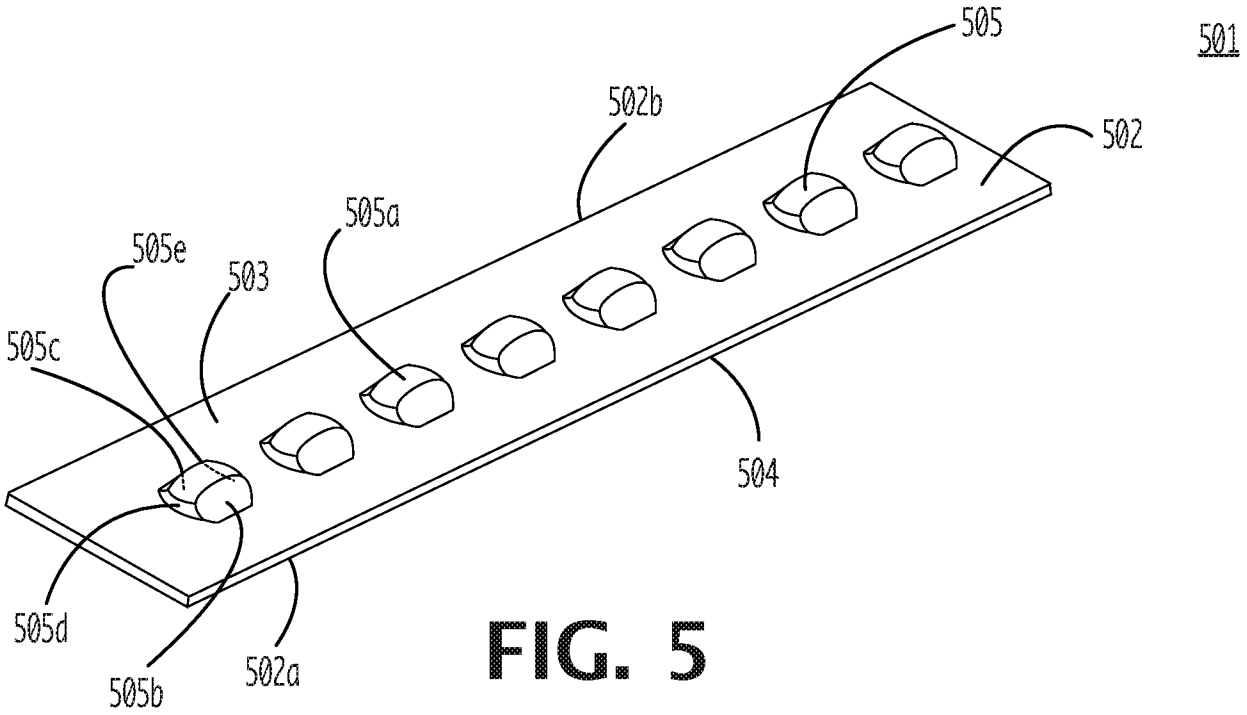
FIG. 5 is a perspective view of another embodiment of the hanger spacer tape.
Figure 6A:
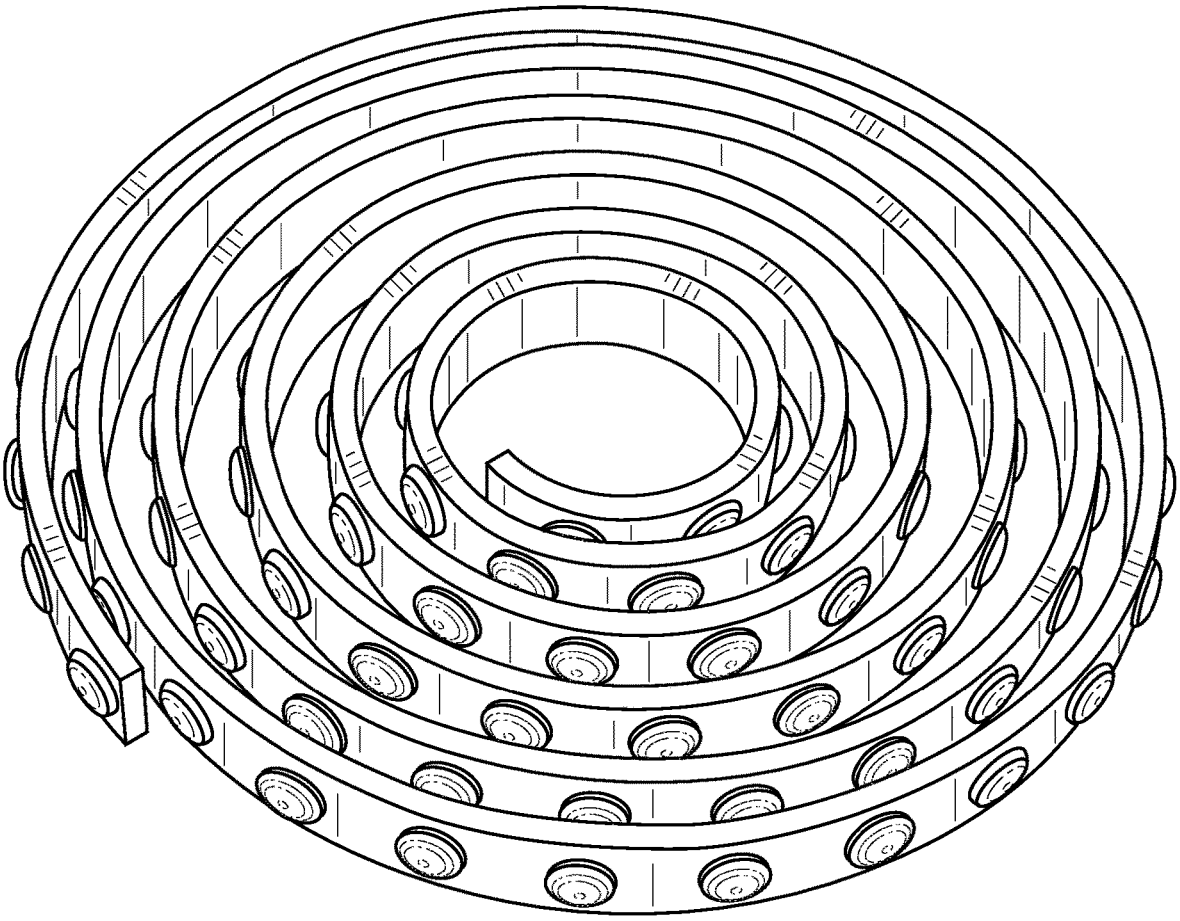
FIGS. 6A-6G are various views of the hanger spacer tape in accordance with the first embodiment.
Figure 6B:
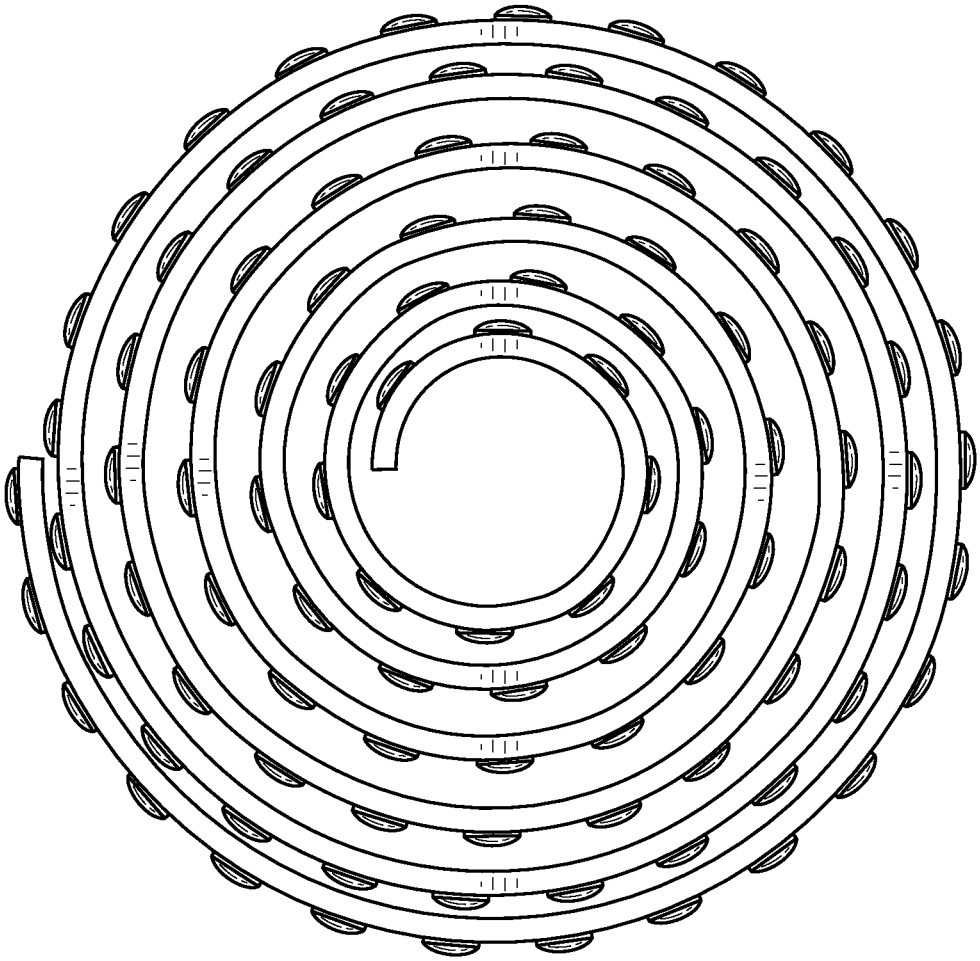
Figure 6C:
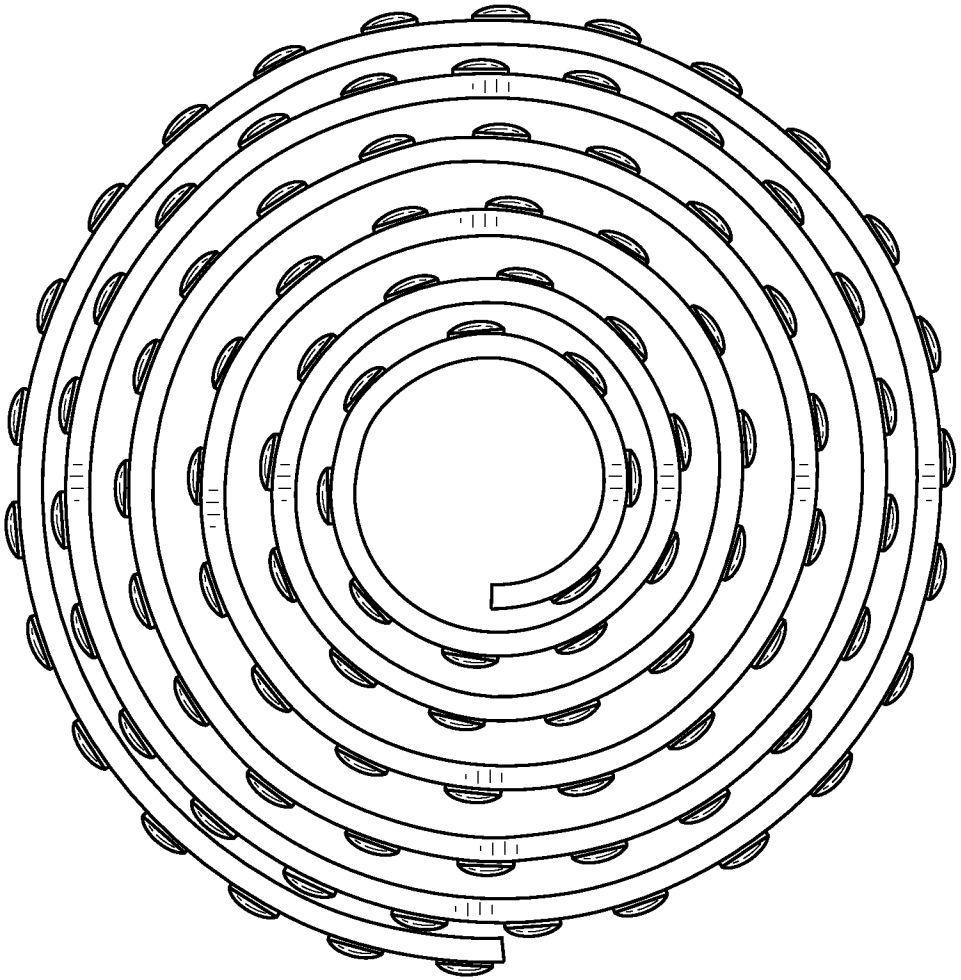
Figure 6D:
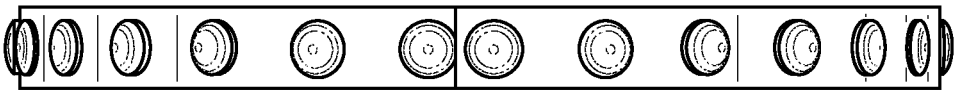
Figure 6E:
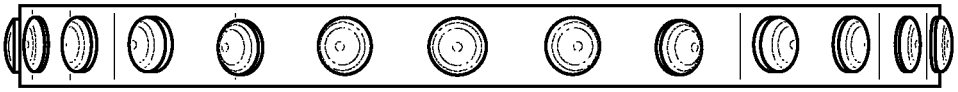
Figure 6F:
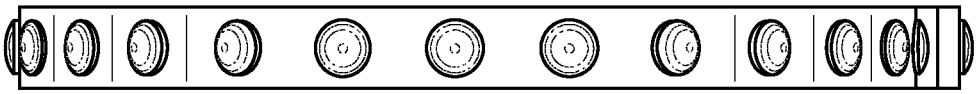
Figure 6G:
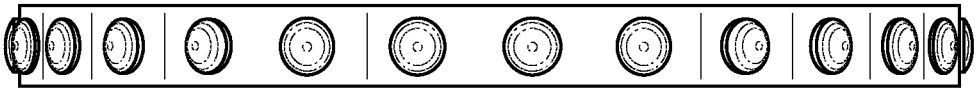

FIG. 5 shows an alternate embodiment, in which a perspective view of another exemplary embodiment of hanger spacer device 501 is shown. Hanger spacer device 501 has a flexible elongated main body 502 with left and right edges 502*a* and 502*b* a top surface 503 and a bottom surface 504. Flexible elongated main body 402 is flexible both lengthwise and widthwise such that it can readily conform to surfaces of varying shapes, such as a rod or pole. Flexible elongated main body 502 can be in the form of a tape. The length of flexible elongated main body 502 is greater than the width of flexible elongated main body 502.

Formed on top surface 503 of the hanger spacer device 501 is a plurality of protrusions or bumps 505. The protrusions or bumps 505 each have a rounded top portion 505*a* and four sides 505*b-e* extending downwardly from each rounded top portion 505*a* toward top surface 503 of the flexible elongated main body 502. Opposing sides 505*b* and 505*c* also extend outwardly from each rounded top portion 505*a*. An adhesive can be provided on bottom surface 504. A perforated section as shown in FIGS. 4A and 4B could also be included in this embodiment.

The hanger spacer tape device can also be used in other places, such as on a curtain rod or shower curtain and can be used in a number of environments outside of a household closet, such as in a garage, storage unit, attic, basement, laundry room or even a car. The hanger spacer tape device could be particularly useful in retail stores where clothing should appear organized and visible to customers.

While other shapes (such as rectangular, square, triangles, stars, hearts, circles with flat tops and trapezoids) can be used, the embodiments described herein provides certain benefits to maximize ease of use.

The flexible elongated main body can vary in thicknesses but should maintain a thickness that allows the main body to easily form around a rounded body such as a rod or pole.

While the foregoing written description of the invention enables one of ordinary skill in the art to make and use the invention, those of ordinary skill in the art will understand and appreciate the existence of variations, combination, and equivalents of the embodiments, methods, and examples provided herein. The invention should, therefore, not be limited by the embodiments and examples disclosed here, but by all embodiments and methods within the scope and spirit of the invention as claimed.

The invention claimed is:

1. A hanger spacing device for keeping hangers spaced at regular intervals comprising:

a flexible elongated main body having a length and a width, said flexible elongated main body having a top surface and a bottom surface, wherein said flexible elongated main body is flexible both lengthwise and widthwise;

a plurality of bumps comprising adjacent pairs of bumps formed on said top surface of said flexible elongated main body, wherein said bumps are spaced apart at regular intervals, wherein each bump has a rounded top and at least one wall extending downwardly from said rounded top and upwardly from said top surface of said flexible elongated main body;

hanger spaces formed between each adjacent pair of bumps, wherein a hanger is configured to be placed in each hanger space respectively;

wherein the hanger spacing device is configured to be mounted to a rod; and wherein the elongated main body is configured to move between a mounting position wherein the main body is configured to become arcuate in shape to conform to an upper surface of the rod and a storage position wherein the main body is configured to be coiled onto itself along the length of the main body in a multilayered overlapping manner.

2. The hanger spacing device of claim 1, wherein an adhesive is provided along said bottom surface of said flexible elongated main body.

3. The hanger spacing device of claim 1, wherein troughs are formed along opposing sides of said plurality of bumps, wherein the troughs extend lengthwise along the entire length of the flexible elongated main body.

4. A hanger spacing device for keeping hangers spaced at regular intervals comprising:

a flexible elongated main body having a length and a width, said flexible elongated main body having a top surface and a bottom surface, wherein said flexible elongated main body is flexible both lengthwise and widthwise;

a plurality of bumps comprising adjacent pairs of bumps formed on said top surface of said flexible elongated main body, wherein said bumps are spaced apart at regular intervals, wherein each bump has a rounded top and at least four sides extending downwardly toward said top surface of said flexible elongated main body and two opposing sides of said four sides extend outwardly from said rounded top and toward said top surface of said flexible elongated main body;

hanger spaces formed between each adjacent pair of bumps, wherein a hanger can be placed in each hanger space respectively;

wherein the hanger spacing device is configured to be mounted to a rod;

wherein the elongated main body is configured to be movable between a mounting position wherein the main body is configured to become arcuate in shape to conform to an upper surface of the rod and a storage position wherein the main body is configured to be coiled onto itself along the length of the main body in a multilayered overlapping manner; and wherein troughs are formed along opposing sides of said plurality of bumps, said troughs extending lengthwise along the entire length of the flexible elongated main body.

5. The hanger spacing device of claim 4, wherein an adhesive is provided along said bottom surface of said flexible elongated main body.

6. A hanger spacing device for keeping hangers spaced at regular intervals comprising:

a flexible elongated main body having a length and a width, said flexible elongated main body having a top surface and a bottom surface, wherein said flexible elongated main body is flexible both lengthwise and widthwise;

a plurality of bumps comprising adjacent pairs of bumps formed on said top surface of said flexible elongated main body, wherein said bumps are spaced apart at regular intervals;

hanger spaces formed between each adjacent pair of bumps, wherein a hanger is configured to be placed in each hanger space respectively;

troughs formed along opposing sides of said plurality of bumps, wherein the troughs extend lengthwise along the entire length of the flexible elongated main body;

wherein the hanger spacing device is configured to be mounted to a rod; and wherein the elongated main body is configured to move between a mounting position wherein the main body is configured to become arcuate in shape to conform to an upper surface of the rod and a storage position wherein the main body is configured to be coiled onto itself along the length of the main body in a multilayered overlapping manner.

7. The hanger spacing device of claim 6, wherein an adhesive is provided along said bottom surface of said flexible elongated main body.

* * * * *